US006640572B2

(12) United States Patent
Doran

(10) Patent No.: US 6,640,572 B2
(45) Date of Patent: Nov. 4, 2003

(54) WALL MOUNTED REFRIGERATOR SYSTEM

(76) Inventor: Michael Doran, 950 Lavers Cir., F103, Delray Beach, FL (US) 33444

( * ) Notice: Subject to any disclaimer, the term of this patent is extended or adjusted under 35 U.S.C. 154(b) by 0 days.

(21) Appl. No.: 10/305,335

(22) Filed: Nov. 25, 2002

(65) Prior Publication Data

US 2003/0074911 A1 Apr. 24, 2003

Related U.S. Application Data

(63) Continuation of application No. 09/898,226, filed on Jul. 3, 2001.

(51) Int. Cl.[7] ..... F25D 23/12
(52) U.S. Cl. ..... 62/263
(58) Field of Search ..... 62/263, 259.1, 62/258, 440, 441

(56) References Cited

U.S. PATENT DOCUMENTS 2,349,541 A * 5/1944 Erie ..... 126/299 R
2,539,613 A * 1/1951 Erie ..... 62/259.1
2,766,594 A * 10/1956 Deissinger ..... 62/259.1
3,017,162 A * 1/1962 Haines et al. ..... 62/180
3,892,452 A * 7/1975 Williams et al. ..... 312/330.1
5,377,498 A * 1/1995 Cur et al. ..... 62/187

* cited by examiner

*Primary Examiner*—William E. Tapolcal
*Assistant Examiner*—Mohammad M. Ali
(74) *Attorney, Agent, or Firm*—Robert M. Downey P.A.

(57) ABSTRACT

A refrigerator system includes one or more insulated cabinets structured and disposed for mounting to a wall, soffit, or ceiling in suspended relation above a countertop so that the insulated cabinets are positioned at a height which enables easy viewing and access to items stored within the cabinets' interior compartments, while also providing an open and unobstructed area between the underside of the cabinets and the countertop. In a preferred embodiment, at least two insulated cabinets are used, including one insulated cabinet providing a refrigerator compartment and a second insulated cabinet providing a freezer compartment. A stand-alone refrigeration and freezing unit for controlling and maintaining the temperature in the refrigerator compartment and the freezer compartment is separated from the insulated cabinets and, in the preferred embodiments, is mounted in a soffit or ceiling structure above the insulated cabinets. The insulated cabinets may be manufactured according to a specific size and configuration and provided with an exterior finish to match adjacent dry storage cabinets in a kitchen, wherein the insulated cabinets and dry storage cabinets are mounted side-by-side.

16 Claims, 5 Drawing Sheets

WALL MOUNTED REFRIGERATOR SYSTEM

This application is a continuation application of co-pending patent application Ser. No. 09/898,226 filed on Jul. 3, 2001.

BACKGROUND OF THE INVENTION

1. Field of the Invention

The present invention relates to modular refrigeration systems and, more particularly, to a refrigerator system including one or more insulated cabinets structured and disposed for mounting to a wall, soffit or ceiling above a countertop, and a refrigeration and freezing unit maintained independent of the insulated cabinets for cooling and/or freezing the insulated interior compartments of the cabinets.

2. Discussion of the Related Art

For many households, the kitchen is often the most active place in the home. In addition to the obvious use for meal preparation and casual dining, the typical kitchen serves as a storage location as well as a place to do homework, family projects and domestic business (i.e. payment of bills, making phone calls, preparation of grocery lists, household chores, etc.). It is, therefore, not surprising that many new home buyers are demanding more counter-top space and cabinet space in the modern-day kitchen. However, extra area in the kitchen is often at a premium, with a significant amount of space being required for installation of appliances.

Of particular concern is the amount of kitchen space occupied by the conventional floor model refrigerator which can be found in practically every home throughout the United States and many other countries. This well known refrigerator style, which has been in use for many decades, sits on the floor, often on small wheels, and stands between 5.5 and 7.0 feet tall. The depth of most floor model refrigerators is approximately 3.5 feet. To accommodate the significant size of the conventional floor model refrigerator, a large pocket of area must be reserved along a wall in the kitchen, often interrupting the continued flow of cabinets and countertops. Accordingly, the installation of a floor model refrigerator results in a loss of cabinets and countertop space in the kitchen.

The floor model refrigerator has presented numerous problems and disadvantages to homeowners over the years. Specifically, it is difficult to clean around, behind and below a floor model refrigerator. In order do this, the refrigerator must be pulled out from the cavity where it normally sits adjacent to or between cabinets and countertops. The constant moving of the refrigerator often results in damage to the floors in the kitchen. Moreover, moisture from condensation in the refrigeration system, as well as spills which inevitably occur when placing or removing items from the refrigerator, sometimes result in puddles under the refrigerator which go unnoticed and eventually cause permanent damage to the kitchen floor. Furthermore, due to the size and structure of the conventional floor model refrigerator, the interior refrigerator and freezer compartments often become cluttered, with many contents being stored below waist level and/or too deep (i.e. near the back) in the refrigerator/freezer compartment. This inefficient use of storage space results in many food items being lost in the refrigerator, sometimes for months. In fact, because many food items are stored below waist level and/or too deep in the conventional floor model refrigerator, these items go unnoticed and eventually spoil. A further disadvantage of the floor model refrigerator is the inability to expand the refrigerator/freezer storage space without having to replace the entire refrigerator with a larger model. In summary, the conventional floor model refrigerator takes up too much space, provides inefficient arrangement of space, with limited adjustability, and results in a loss of countertop and cabinet space in the kitchen.

In the past, others have proposed departures from the conventional floor model refrigerator design to address concerns other than those of the present invention. Of particular relevance is the U.S. Patent to Dehring, U.S. Pat. No. 4,759,193 which discloses a horizontal refrigerator that rests on or just above the floor. Access to the Dehring Horizontal Refrigerator is provided via top covers which hinge upwardly and towards the wall behind the refrigerator. And, while the Dehring Horizontal Refrigerator provides for ease of access to some of the contents which are stored below the hinged-top covers, its structure and design does not provide for an increased amount of countertop space in the kitchen. Specifically, it is not practical to place any items on the top of the hinged covers of the Horizontal Refrigerator, as this will prevent opening of the covers to access the interior of the refrigerator. Furthermore, the Dehring Horizontal Refrigerator fails to provide for storage of contents above waist level so that they are more easily viewable and accessible to persons using the refrigerator.

Accordingly, in view of the foregoing, it is quite apparent that there remains an urgent need in the industry for improvements to the conventional refrigerator design and structure in order to overcome the long-standing problems and disadvantages of the conventional floor model refrigerator.

SUMMARY OF THE INVENTION

The present invention is directed to a refrigerator system which includes one or more insulated cabinets, each providing a refrigerator compartment or a freezer compartment. The individual insulated cabinets are structured and disposed for mounting to a wall or overhead soffit or ceiling structure so that the insulated cabinets are positioned at a height which enables easy viewing and access to items stored therein. To accomplish this, the system of the present invention provides means for supporting the insulated cabinets in suspended relation above the counter-top. The suspended mounting of the insulated cabinets not only positions the cabinets at a convenient height but provides an open and unobstructed area below the underside of the insulated cabinets and the countertop, thereby increasing the available amount of useful counter space for placement of items such as coffee makers, microwaves, toasters, cutting boards, and other appliances and/or accessories. The suspended mounting system also provides for increased workspace on the countertop. A refrigeration and freezing unit is maintained independently of the insulated cabinets and controls and maintains the temperature in each of the refrigerator and freezer compartments. In a preferred embodiment, the refrigeration and freezing unit is separated from the insulated cabinets and is mounted in the soffit or ceiling structure above the insulated cabinets. It is intended that the insulated cabinets be mounted adjacent to dry storage cabinets in the kitchen and in spaced relation above the countertop. For interior design purposes, the insulated cabinets may be manufactured according to a specific size and configuration and provided with an exterior finish to match adjacent storage cabinets in the kitchen. The refrigerator system may further provide base insulated cabinets which mount below the countertop for fresh food, freezer or deep freeze storage. Accordingly, the present invention provides a compartmental refrigerator system comprising individual insulated cabinets which mount to a wall or overhead soffit or ceiling structure and which are designed to match the appearance of dry storage cabinets, thereby providing conveniently accessible refrigeration and freezer storage space and ease of expandability of the refrigerator system, while also increasing available countertop space in the kitchen.

OBJECTS AND ADVANTAGES OF THE INVENTION

With the foregoing in mind, it is a primary object of the present invention to provide a compartmental refrigerator system including one or more wall-mounted insulated cabinets and a stand-alone refrigeration and freezing unit which provides for ease of expandability of the system by adding additional refrigerator and/or freezer compartments at minimal cost while also providing increased available countertop area in the kitchen.

It is a further object of the present invention to provide an improved refrigerator system, as described above, which provides for maximum efficiency of used spaced.

It is still a further object of the present invention to provide an improved refrigerator system, as described above, which provides for efficient organization and customization according to the design of a kitchen and the needs of the user.

It is still a further object of the present invention to provide an improved refrigerator system, as described above, which avoids the problems of having to clean behind or under the refrigerator cabinet, as occurs with the conventional floor model refrigerator.

It is still a further object of the present invention to provide an improved refrigerator system, as described above, which supports one or more insulated cabinets in suspended relation above the countertop, thereby providing an open and unobstructed area between the entire underside of the insulated cabinets and the countertop to increase available countertop space.

It is still a further object of the present invention to provide an improved refrigerator system, as described above, which includes one or more insulated cabinets to provide refrigerator and/or freezer compartments, and wherein the individual insulated cabinets are structured for mounting to a wall, soffit or overhead ceiling structure so that the contents stored in the refrigerator and/or freezer compartment are maintained at a convenient height which is above waist level.

It is yet a further object of the present invention to provide an improved refrigerator system, as described above, which can be manufactured according to a specific size and configuration in order to match dry storage cabinets in a kitchen, so that the insulated refrigerator and/or freezer cabinets of the system blend in with the dry storage cabinets in the kitchen.

It is still a further object of the present invention to provide an improved refrigerator system, as described above, wherein individual insulated refrigerator and/or freezer cabinets are adapted for wall mounting, ceiling mounting or soffit mounting at a height which is out of the reach of small children.

These and other objects and advantages of the present invention are more readily apparent with reference to the accompanying drawings and the detailed description which follows.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENTS

Figure 4:
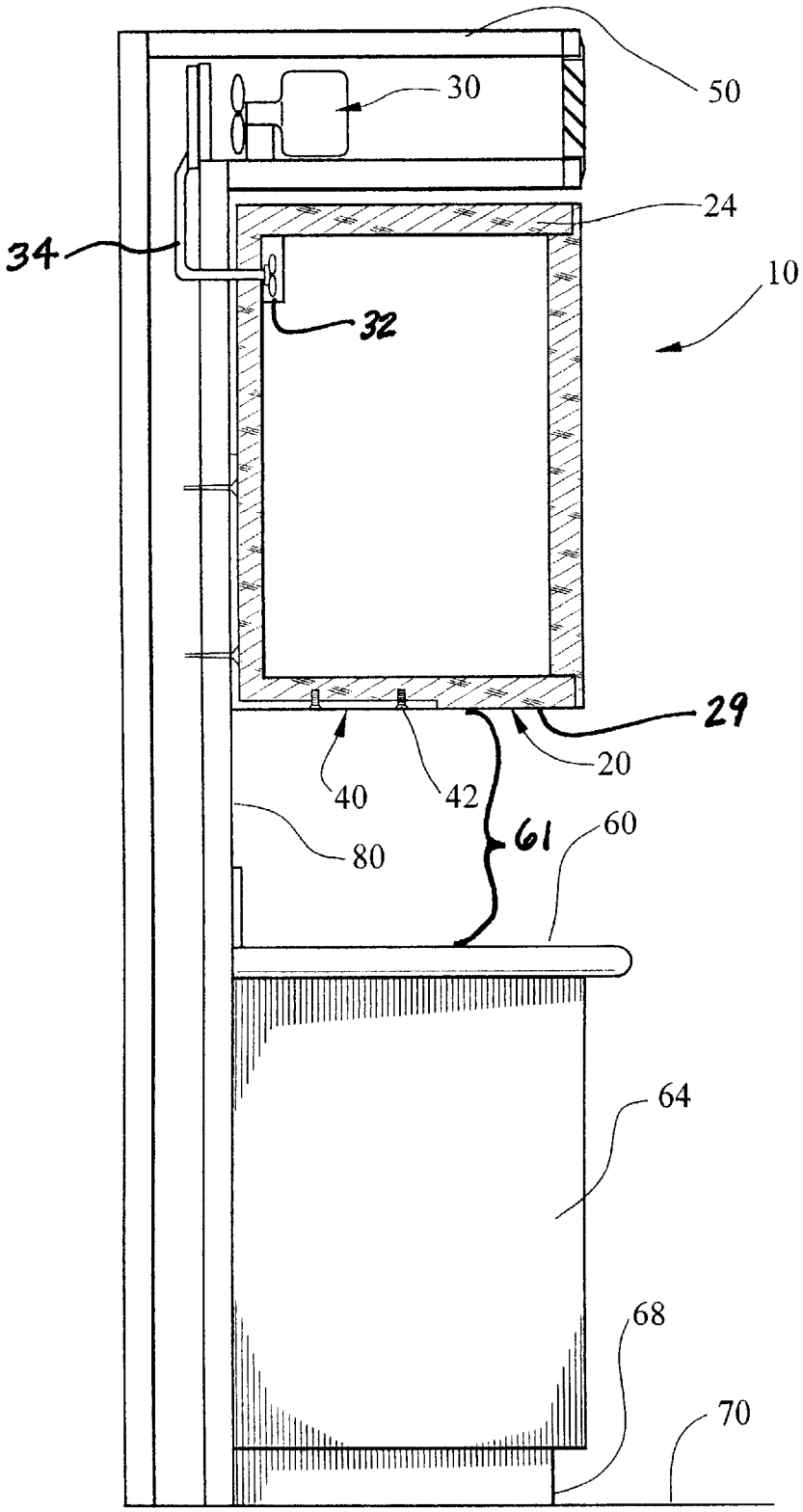
FIG. 4 is a side elevational view, in partial section, showing an insulated cabinet of the refrigerator system mounted to a wall in a kitchen, above a countertop, and a stand-alone refrigeration and freezing system installed within a soffit above the insulated cabinet.
Figure 5:
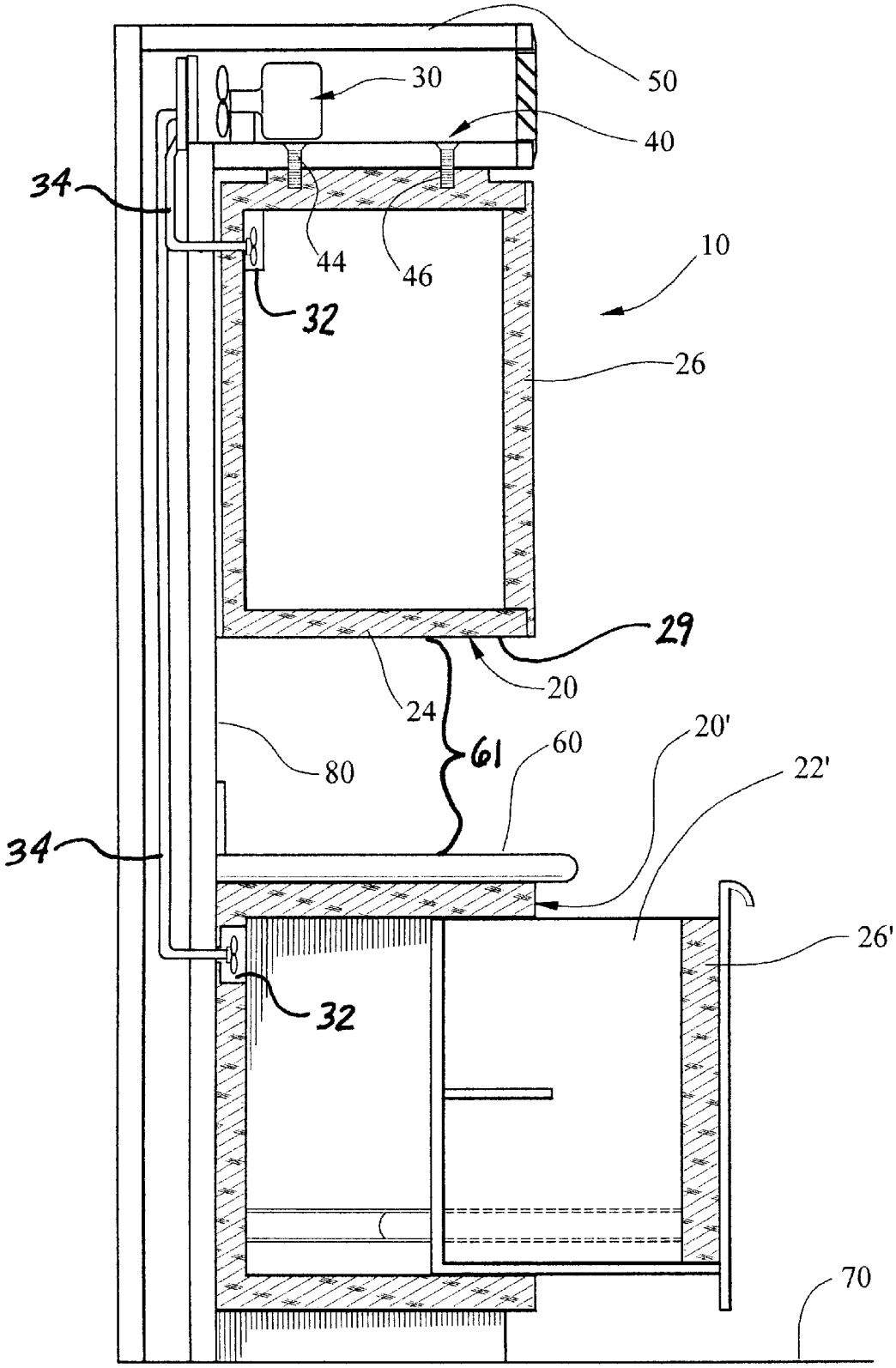
FIG. 5 is a side elevational view, shown in cross section, illustrating a first insulated cabinet of the refrigerator system mounted to the underside of an overhead soffit in a kitchen, with the first cabinet supported in spaced relation above a countertop, and a second base insulated cabinet mounted below the countertop, wherein both of the insulated cabinets are interconnected and cooled/frozen by a stand-alone refrigeration and freezing unit maintained within the soffit.

As seen throughout the several views of the drawings, the present invention is directed to a refrigerator system, generally indicated as 10, and including one or more insulated cabinets 20 and a stand-alone refrigeration and freezing unit 30, shown diagrammatically in FIGS. 4 and 5.

Figure 1:
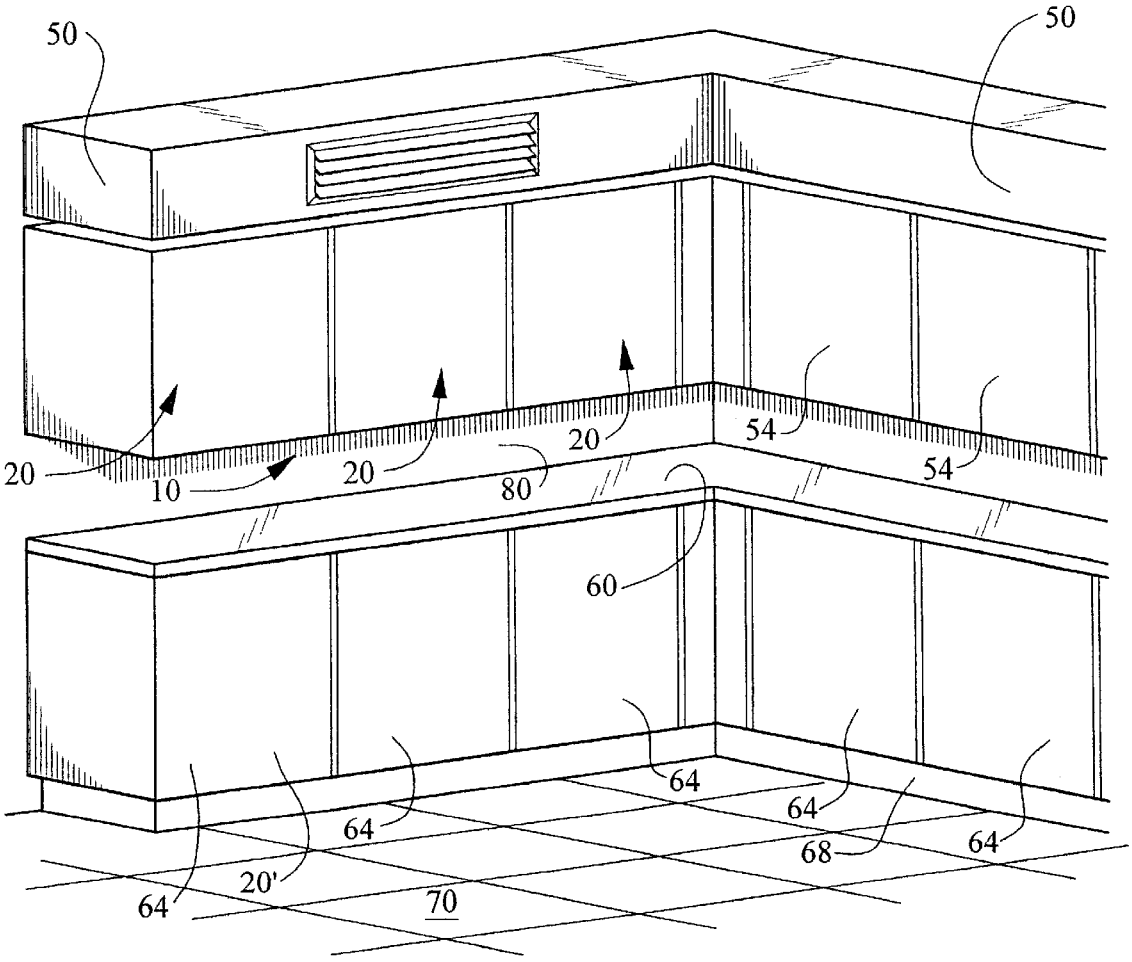
FIG. 1 is a perspective view showing the refrigerator system of the present invention installed in a kitchen.
Figure 2:
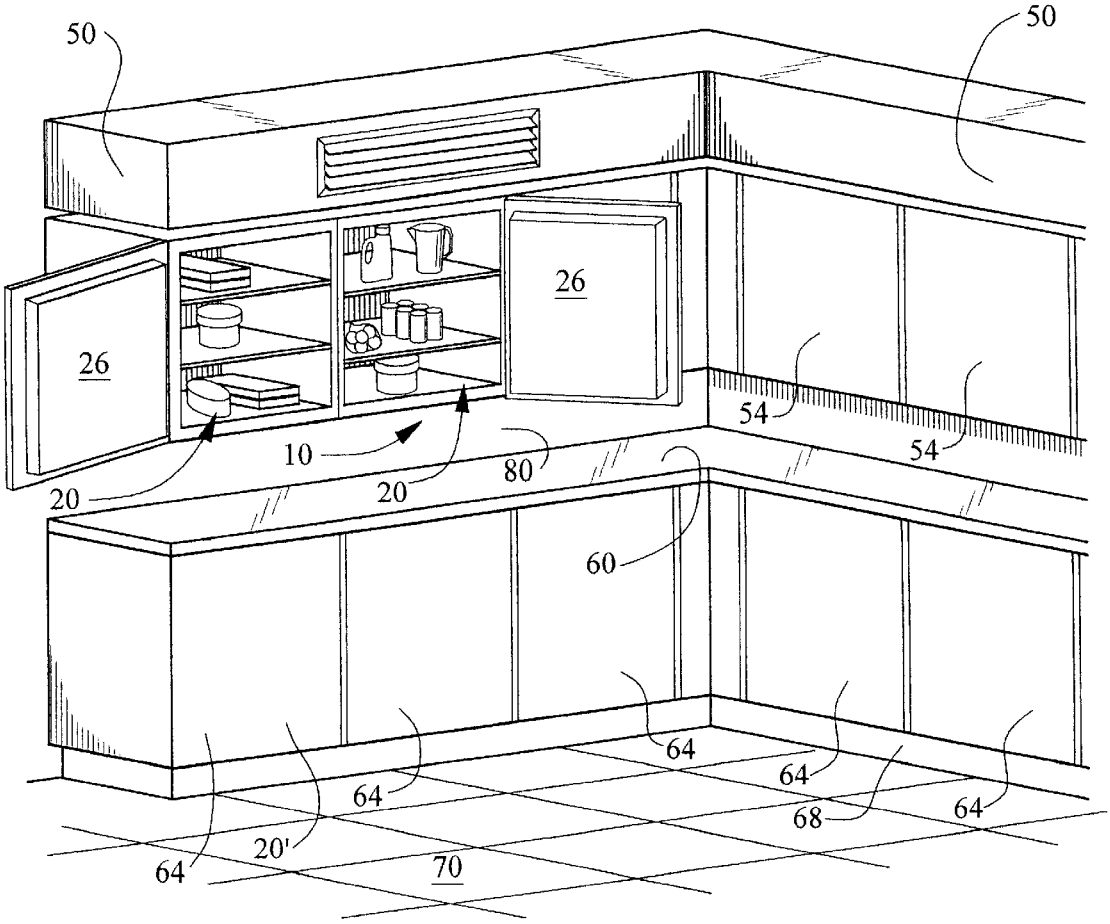
FIG. 2 is a perspective view showing the refrigerator system of the present invention installed in a kitchen with the hinged doors of insulated refrigerator cabinets of the system in an open position to permit access to the contents stored therein.

Referring initially to FIGS. 1 and 2, a perspective view of a kitchen is shown to illustrate an intended installation and use of the refrigerator system 10 of the present invention. Specifically, a typical kitchen wherein the system 10 may be installed includes a ceiling structure or overhead soffit 50 and a countertop 60. A first set of dry storage cabinets 54 are mounted below the soffit in a side-by-side horizontal arrangement so that a bottom of the cabinets is spaced above the countertop surface, preferably at a height of greater than two feet above the countertop, to thereby provide unobstructed access and use of the countertop. The typical kitchen further includes lower dry storage cabinets 64 below the countertops 60. The lower cabinets 64 may rest on a footing 68 or on the floor 70.

Each insulated cabinet 20 is provided with an insulated wall structure 24 and a moveable insulated door 26 which surround an interior storage compartment 22. In the preferred embodiment, the insulated doors 26 are hinged to the insulated wall structure of the cabinet to permit swinging movement of the doors between a closed position, as seen in FIG. 1, and an open position, as seen in FIG. 2.

Figure 3:
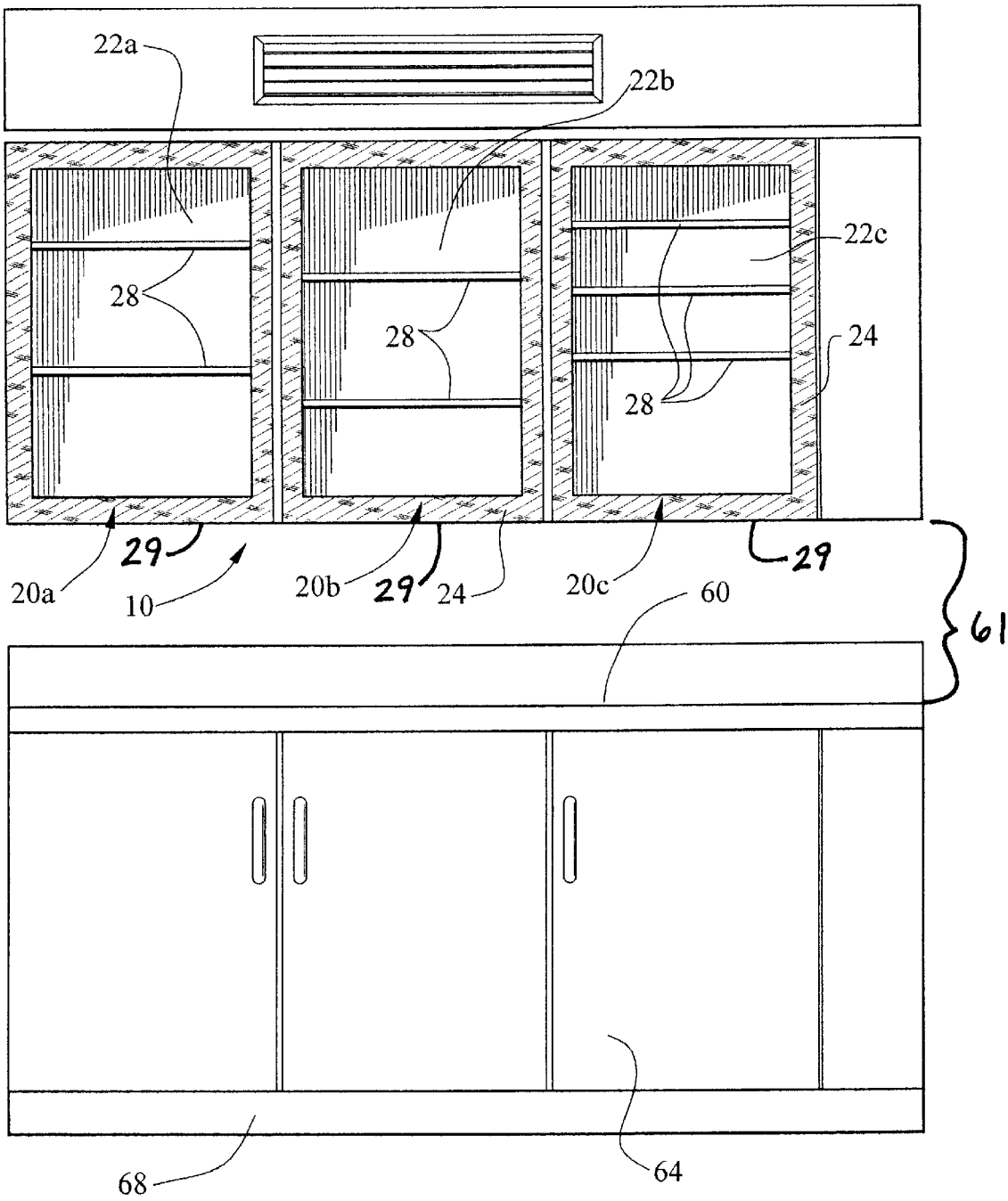
FIG. 3 is a front elevational view, in partial section, showing insulated refrigerator and freezer cabinets of the refrigerator system of the present invention installed adjacent to dry storage cabinets in a kitchen, and in spaced relation above a countertop.

The insulated cabinets 20 of the refrigerator system 10 are specifically structured and disposed for mounting to a wall 80 which extends upwardly from the countertop to the soffit or ceiling structure. More specifically, the insulated cabinets 20 are structured and disposed for mounting to the wall 80 or overhead soffit or ceiling structure 50 so that they are suspended in adjacent, side-by-side relation to the upper dry storage cabinets in the kitchen in spaced relation above the countertop, as seen throughout the several views of the drawings. For example, as seen in FIGS. 1–3, three independent insulated cabinets 20*a*, 20*b* and 20*c* are mounted to the wall in side-by-side, adjacent relation to one another and along the same horizontal plane as the upper dry storage cabinets 54. In this particular example, insulated cabinets 20*a* and 20*b* may be used to provide two independent refrigerator compartments 22*a* and 22*b*. The third insulated cabinet 20*c* may be used to provide a freezer compartment 22*c*. Adjustably positionable shelves 28 are provided and can be arranged according to the needs of the user to accommodate for various sized items in both the refrigerator compartments 22*a*, 22*b* as well as the freezer compartment 22*c*.

Mounting means 40 are provided for supporting the insulated cabinets 20 in suspended relation above the countertop 60. The mounting means 40 anchor to the wall 80 or an overhead soffit or ceiling structure 50, as seen in FIGS. 4 and 5. Specifically, one or more L-shaped brackets 42 may be provided for mounting each of the insulated cabinets 20 to the wall 80, as seen in FIG. 4. In this particular embodiment, the L-shaped mounting brackets 42 attach to the bottom of the insulated cabinets 20 and to the wall 80 and effectively support the weight of each insulated cabinet 20 and the contents therein. Conventional hardware, such as steel anchors and/or toggle anchors may be used to secure the L-shaped bracket 42 to the wall 80. Alternatively, the insulated cabinets 20 may be mounted to the overhead soffit or ceiling structure 50 with the use of bolts 44 or other hardware which are received within threaded bushings 46 or other suitable hardware provided on the top wall of the insulated cabinets 20, as seen in FIG. 5. In each of these embodiments, the cabinets 20 are actually supported in suspended relation above the countertop 60 so that an open and unobstructed area 61 remains between the underside 29 of the cabinets 20 and the countertop 60.

As best seen in FIGS. 4 and 5, the refrigeration and freezing unit 30 is preferably maintained in the soffit 50 as an independent, stand-alone unit. The refrigeration and freezing unit 30 comprises a compressor, a condenser and an evaporator. An appropriate air moving device, such as one or more motor-driven fans 32, may be provided to circulate the air from the refrigeration and freezing unit 30 to the interior storage compartments 22 of the insulated cabinets 20. The fans 32 may be located within the interior storage compartments 22 or exterior of the cabinets 20 at any location along an air-circulating conduit 34 connecting between the refrigeration and freezing unit 30 and the cabinets 20. For purposes of this disclosure, the fans 32 or other air moving devices are not considered to be a component part of the stand-alone refrigeration and freezing unit 30.

The refrigeration and freezing unit 30 is interconnected to each of the insulated cabinets 20 via the air circulation conduits 34 to provide a specific, controlled temperature to each of the respective interior storage compartments 22 of the insulated cabinets 20. Controls are provided for adjusting the temperature and humidity in each of the interior storage compartments 22 of the insulated cabinets 20, thereby providing for refrigeration of fresh foods, and freezing and deep freezing of frozen food products. It is noted that the refrigeration and freezing unit 30 may be contained in one of the insulated cabinets, or a dedicated dry cabinet interconnected to other insulated cabinets. And, such an arrangement and positioning of the refrigerator and freezer unit is fully contemplated within the spirit and scope of the present invention.

A further embodiment of the present invention is shown in FIG. 5, wherein a base insulated cabinet unit 20' is provided below the countertop 60. The base insulated cabinet unit 20' may be provided with a swinging door, as described in connection with the insulated cabinets 20 or, alternatively, a sliding drawer 26' which pulls out on tracks to facilitate access to the interior storage compartment 22' of the drawer 26'. Similar to the insulated cabinets 20 described above, the interior storage compartment 22' of the base insulated cabinet unit 20' is inter-connected with the refrigeration and freezing unit 30 to provide a controlled temperature therein. One or more of the base insulated cabinet units 20' may be installed to provide a refrigerator compartment and/or a freezer or deep freezer compartment.

It is readily apparent from the foregoing description and the accompanying drawings that the refrigerator system 10 of the present invention is adapted to provide optimal utilization of space while further providing a compartmental modular system which offers ease of expandability and installation. Moreover, the insulated cabinets 20 which mount to the wall or soffit are positioned at a height so that the contents are easily accessible at a level above the waist, thereby eliminating the need to bend or crouch in order to search for items in the refrigerator or freezer. The insulated cabinets 20, as well as the base insulated cabinet units 20' are further adapted for installation in side-by-side, adjacent position to the upper and lower dry storage cabinets 54, 64 so that the insulated cabinets of the refrigerator system match and blend in with the dry storage cabinets, thereby providing a neat, organized and aesthetic appearance to the kitchen.

While the present invention has been shown and described in connection with various preferred embodiments thereof, it is recognized that departures from the instant disclosure are contemplated within the spirit and scope of the invention which is not to be limited except as set forth in the following claims as interpreted under the doctrine of equivalents.

What is claimed is:

1. A refrigerator system for installation in a kitchen having a countertop and a plurality of dry storage cabinets mounted in spaced relation above the countertop, said refrigerator system comprising:

at least one cabinet including at least one interior storage compartment surrounded by insulated walls and an insulated moveable door, and said door being moveable between a closed position to sealingly enclose said interior storage compartment and an open position to permit access to said interior storage compartment;

means for supporting said cabinet independently of the countertop and in suspended and spaced relation above the countertop to provide an open and unobstructed area between the entire underside of said cabinet and the countertop; and means for cooling and/or freezing said interior storage compartment.

2. The refrigerator system as recited in claim 1 comprising:

a plurality of said cabinets including at least one refrigerator cabinet having an interior refrigerator compartment, and at least one freezer cabinet having an interior freezer compartment; and said means for cooling and/or freezing being structured and disposed for cooling said interior refrigerator compartment of said at least one refrigerator cabinet and said means for cooling and/or freezing being further structured and disposed for freezing said interior freezer compartment of said at least one freezer cabinet.

3. The refrigerator system as recited in claim 2 wherein said plurality of cabinets are sized and configured for mounting adjacent to said dry storage cabinets.

4. The refrigerator system as recited in claim 3 wherein said plurality of cabinets are provided with an exterior finish to match said plurality of dry storage cabinets.

5. The refrigerator system as recited in claim 1 wherein said means for supporting includes at least one bracket structured and disposed for attachment to a wall in the kitchen and said cabinet for supporting said cabinet above the countertop.

6. The refrigerator system as recited in claim 1 wherein said means for supporting includes at least one bracket structured and disposed for attachment to a soffit and said cabinet for supporting said cabinet above the countertop.

7. The refrigerator system as recited in claim 1 wherein said means for supporting includes at least one bracket structured and disposed for attachment to a ceiling and said cabinet for supporting said cabinet above the countertop.

8. A refrigerator system for installation in a kitchen having a countertop and a plurality of dry storage cabinets mounted in spaced relation above the countertop, said refrigerator system comprising:

a plurality of individual and separable cabinet units including:

at least one refrigerator cabinet unit having at least one interior refrigerator compartment surrounded by insulated walls and an insulated moveable door;

at least one freezer cabinet unit having at least one interior freezer compartment surrounded by insulated walls and an insulated moveable door;

said individual cabinets being structured and disposed for independent installation to allow selective positioning and arrangement of each of said individual cabinets relative to one another, and said system further comprising:

means for independently supporting select ones of said plurality of individual cabinet units in suspended and spaced relation above the countertop to provide an open and unobstructed area between the entire underside of said cabinet and the countertop; and cooling and freezing means for cooling said refrigerator compartment and for freezing said freezer compartment.

9. The refrigerator system as recited in claim 8 wherein at least one of said plurality of individual cabinet units is structured and disposed for mounting below the countertop.

10. The refrigerator system as recited in claim 9 wherein each of said plurality of individual cabinet units is structured and disposed for mounting adjacent to said plurality of dry storage cabinets.

11. The refrigerator system as recited in claim 10 wherein each of said plurality of individual cabinet units is provided with an exterior finish to match an exterior finish of said plurality of dry storage cabinets.

12. A refrigerator system for installation in a kitchen having a countertop and a plurality of dry storage cabinets mounted in spaced relation above the countertop, said refrigerator system comprising:

at least one cabinet including at least one interior storage compartment surrounded by insulated walls and an insulated moveable door, and said door being moveable between a closed position to sealingly enclose said interior storage compartment and an open position to permit access to said interior storage compartment;

means for supporting said cabinet independently of the countertop and including bracket means for holding said cabinet in suspended, spaced relation above the countertop to provide an open and unobstructed area between the entire underside of said cabinets and the countertop; and means for cooling and/or freezing said interior storage compartment.

13. The refrigerator system as recited in claim 12 comprising:

a plurality of said cabinets including at least one refrigerator cabinet having an interior refrigerator compartment, and at least one freezer cabinet having an interior freezer compartment; and said means for cooling and/or freezing being structured and disposed for cooling said interior refrigerator compartment of said at least one refrigerator cabinet and said means for cooling and/or freezing being further structured and disposed for freezing said interior freezer compartment of said at least one freezer cabinet.

14. The refrigerator system as recited in claim 13 wherein said bracket means is structured and disposed for attachment to a soffit and said cabinet for supporting said cabinet in suspended relation above the countertop.

15. The refrigerator system as recited in claim 13 wherein said bracket means is structured and disposed for attachment to a ceiling and said cabinet for supporting said cabinet in suspended relation above the countertop.

16. The refrigerator system as recited in claim 13 wherein said bracket means is structured and disposed for attachment to a wall and said cabinet for supporting said cabinet in suspended relation above the countertop.

* * * * *